United States Patent [19]

Clausen

[11] 4,037,814

[45] July 26, 1977

[54] CONTAINER SUPPORT AND HOLDER

[76] Inventor: Anthony Robin Clausen, 7 Klip Street, Observatory, Johannesburg, Transvaal Province, South Africa

[21] Appl. No.: 512,572

[22] Filed: Oct. 7, 1974

[30] Foreign Application Priority Data

Oct. 18, 1973 South Africa ..... 73/8107

[51] Int. Cl.[2] ..... A47F 1/00; A62C 31/78

[52] U.S. Cl. ..... 248/311.1; 169/51

[58] Field of Search ..... 248/203, 201, 204, 205 R, 248/127, 146, 147, 152, 153, 174, 175, 300, 309, 310, 311, 314, 316 R, 316 D, 108, 109; 211/60, 71, 4, 72–76, 83, 84; 169/51; 222/173, 179.5, 180, 182

[56] References Cited

U.S. PATENT DOCUMENTS

| | | | |
|---|---|---|---|
| 1,337,234 | 4/1920 | Kopf | 248/203 |
| 1,816,892 | 8/1931 | Bronander | 169/51 |
| 1,919,316 | 7/1933 | Bronander | 169/51 |
| 2,234,360 | 3/1941 | Whitson | 248/203 |
| 2,561,595 | 7/1951 | Putnam | 211/76 X |
| 3,081,056 | 3/1963 | Young et al. | 248/203 |
| 3,648,778 | 3/1972 | Huthsing, Jr. | 222/179.5 X |

FOREIGN PATENT DOCUMENTS

| | | | |
|---|---|---|---|
| 674,096 | 10/1929 | France | 169/51 |

*Primary Examiner*—Roy D. Frazier
*Assistant Examiner*—Terrell P. Lewis
*Attorney, Agent, or Firm*—Pollock, Vande Sande & Priddy

[57] ABSTRACT

A container support comprising a holder for removably holding an aerosol fire extinguisher container, a protective cap for protecting an actuating button and outlet nozzle of the container when held by the nozzle, complementary engagement means on the protective cap and holder for locating the cap in its operative position on the holder, and bias means on the cap and holder which is adapted to be triggered by withdrawal of the container from the holder to bias the cap and holder away from each other until sudden disengagement of the complementary engagement means results in the protective cap flipping off and away from the holder to expose the actuating button and nozzle for use.

10 Claims, 24 Drawing Figures

CONTAINER SUPPORT AND HOLDER

This invention relates to a container support and a holder for a container.

According to the invention there is provided a container support comprising a holder for removably holding a container, a protective cap for protecting an outlet of a container held by the holder, engagement means for locating the cap in its operative position on the holder, and bias means adapted to be triggered by withdrawal of a container from the holder to bias the cap and holder away from each other until disengagement of the engagement means results in the protective cap flipping into an inoperative position.

The cap may be pivotally or slidably connected to the holder. The cap may therefore, when flipping into an inoperative position, execute a pivotal or sliding movement relatively to the holder.

In an alternative embodiment of the invention, the cap may be removably connected, or may be adapted to be removably connected to the holder, and may thus be adapted to become entirely detached from the holder upon flipping into its inoperative position.

In an embodiment of the invention, the bias means may include a bias zone on the protective cap, with the bias zone being adapted to be displaced by a container during withdrawal from the holder until disengagement of the engagement means results in the protective cap flipping into an inoperative position.

In an alternative embodiment of the invention, the bias means may include a bias zone on the holder, with the bias zone being adapted to be displaced by a container during withdrawal thereof from the holder until disengagement of the engagement means results in the protective cap flipping into an inoperative position.

In a further alternative embodiment of the invention, the bias means may comprise or include a bias spring or the like, to bias the cap and holder away from each other until disengagement of the engagment means results in the protective cap flipping into an inoperative position.

The holder may conveniently include locating means to locate the protective cap relatively to the holder and combat displacement of the cap together with a container during withdrawal thereof from the holder.

The holder may include shoulder means to combat axial displacement of a container held by the holder.

The holder may include at least a first pair of resiliently flexible arms for holding a container in position in the holder.

In this embodiment of the invention, the engagement means may conveniently comprise complementary engagement formations on the cap and the first pair of resiliently flexible arms.

The holder may conveniently include a second pair of resiliently flexible arms laterally spaced from the first pair of resiliently flexible arms.

The holder may be of any suitable material. Thus, for example, it may be of metal, of a suitable synthetic plastics material, or the like.

In one embodiment of the invention, the holder may comprise a backstrap portion which is adapted to be secured to a surface, and two pairs of resiliently flexible arms which extend from the backstrap portion and are laterally spaced from each other.

In this embodiment of the invention, the holder may conveniently be moulded out of a suitable synthetic plastics material, and may be moulded in one piece, two pieces or three pieces.

Where it is moulded in more than one piece, complementary connecting formations may be provided on the separate pieces for connecting the separate pieces together.

Thus, for example, at least one pair of resiliently flexible arms may have a groove or slot formation for receiving portion of the backstrap portion or a tongue formation forming part of the backstrap portion to thereby connect the separate pieces together. In this embodiment, complementary locking formations may be provided for locking the separate pieces together once the connecting formations have been connected.

This invention can have application in regard to any suitable type of containers. It can have particular application in regard to containers which are required for emergency purposes such as containers or pressurized containers for combatting fires, for protective purposes, for self-defence purposes, for crowd control purposes, and the like. This invention can further have particular application in regard to containers which usually tend to be used, or are conveniently used by a user employing only one hand.

This invention would therefore tend to have specific application in regard to containers of the aerosol type having an outlet or outlet nozzle provided in an actuating knob. For this application of the invention, the protective cap would be shaped to protect the outlet and the actuating knob during use.

The invention therefore extends to a container support as herein described, including an aerosol container to be held by the holder.

The invention further extends to a holder for removably holding an elongated container, and comprising a backstrap portion adapted to be secured to a surface, and a pair of resiliently flexible arms at each end of the backstrap portion for engaging with an elongated container, each pair of resiliently flexible arms having shoulder formations to combat axial displacement of a container held by the holder, and one pair of resiliently flexible arms having engagement formations for removably engaging with complementary engagement formations of a protective cap to locate the cap on the holder.

Embodiments of the invention are now described by way of example with reference to the accompanying drawings.

Figure 1:
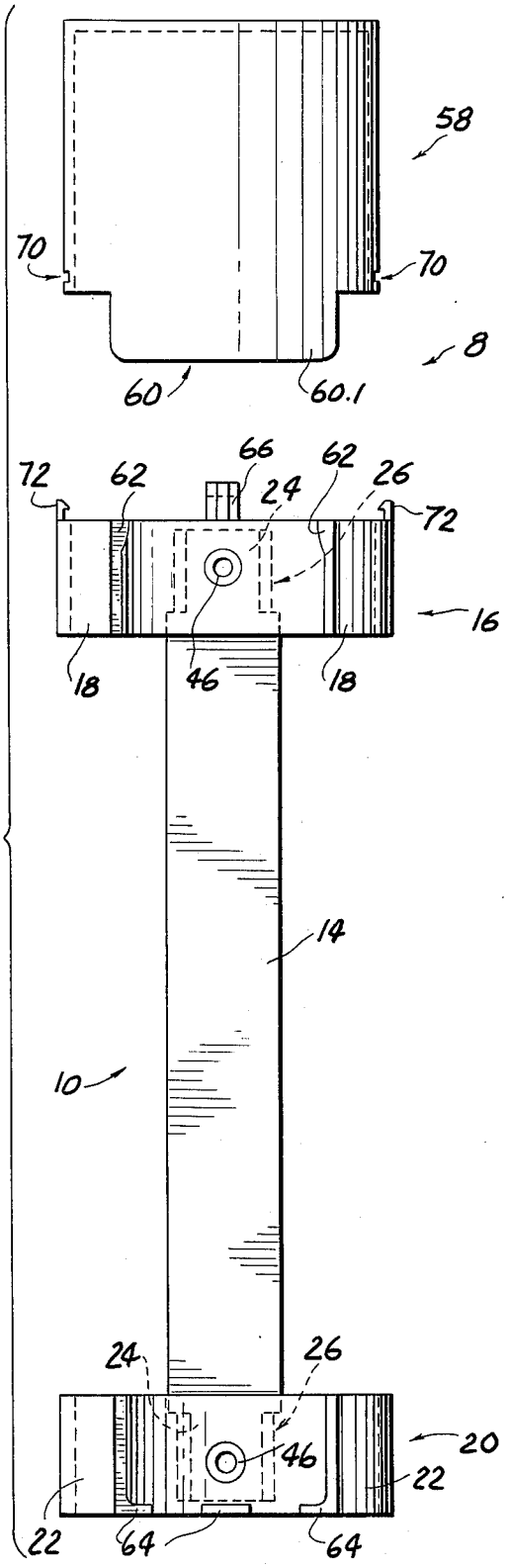
FIG. 1 shows a front elevation of a container support for an aerosol fire extinguisher container, comprising a holder and a protective cap in position for engagement with the holder.

With reference to the drawings, where like parts are indicated by like reference numerals, reference numeral 8 refers generally to a container support for removably supporting an aerosol fire extinguisher container.

Figure 3:
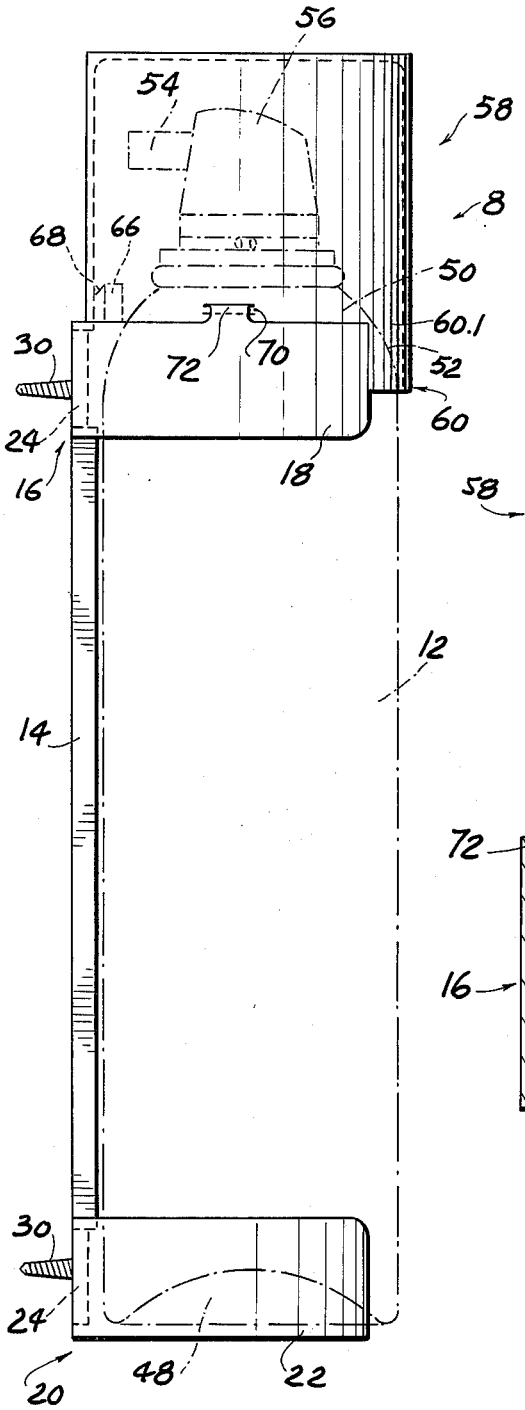
FIG. 3 shows a side elevation of the container support of FIGS. 1 and 2, with the cap in its operative position on the holder.

The container support 8 comprises a holder generally indicated by reference numeral 10, for removably holding an aerosol fire extinguisher container 12 as indicated in dotted lines in FIG. 3 of the drawings.

The holder 10 includes a backstrap portion 14, a top clip 16 comprising a first pair of resiliently flexible arms 18, and a bottom clip 20 comprising a second pair of resiliently flexible arms 22.

The holder 10 is conveniently moulded out of a suitable synthetic plastics material. Any suitable synthetic plastics material such as, for example, polypropylene, acetal plastic, polyphenylene oxide (available under the trade mark VALOX), or the like may be used, which will allow the arms 18 and 22 to be sufficiently resiliently flexible for an aerosol container 12 to be inserted into the holder 10, or to be withdrawn from the holder 10.

The holder 10 is conveniently moulded in three pieces so that the backstrap 14, the top clip 16 and the bottom clip 20 are separately moulded.

In this case, the backstrap 14 is moulded so that it has connecting formations 24 at its opposed ends, and the top clip 16 and bottom clip 20 are moulded so that they have complementary connecting formations 26 for receiving the connecting formations 24 to connect the backstrap 14 and the top clip 16 and bottom clip 20 together.

Figure 5:
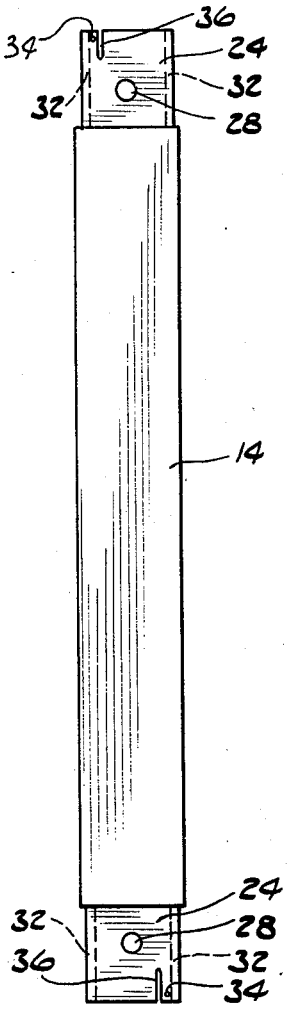
FIG. 5 shows a plan view of a backstrap portion of the holder of FIGS. 1 to 4.
Figure 6:
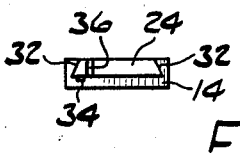
FIG. 6 shows an end elevation of the backstrap portion of FIG. 5.

The connecting formations 24 are illustrated in various Figures of the drawings, but are particularly illustrated in FIGS. 5 and 6 of the drawings.

With particular reference to FIGS. 5 and 6 of the drawings, the backstrap 14 is moulded so that the connecting formations 24 at the opposed end of the backstrap 14, are narrower and thinner than the remainder of the backstrap 14.

Each connecting formation 24 has a hole 28 through which a fixing screw 30 (as illustrated in FIG. 3 of the drawings) can pass for securing the bottom and top clips 16 and 20 to the backstrap 14, and for securing the holder 10 to a desired support surface.

Each connecting formation 24 has opposed tapered edges 32 for the purpose as hereinafter described. Each connecting formation 24 further has a locking formation 34 for locking the connecting formation 24 in position when connected to a complementary connecting formation 26.

The locking formation 34 may be in the form of a stud or the like, or in the form of a wedge-shaped element having a tapered face to facilitate insertion of the connecting formation 24 into a complementary connecting formation 26, and a vertical face to combat withdrawal of the connecting formation 24 from a complementary connecting formation 26.

Each connecting formation 24 further has a longitudinally extending slot 36 to allow the portions of the connecting formation 24 on opposed sides of the slot 36, to be displaced towards each other during insertion of a connecting formation 24 into a complementary connecting formation 26, thereby facilitating insertion of the connecting formation 24 into a complementary connecting formation 26.

Figure 12:
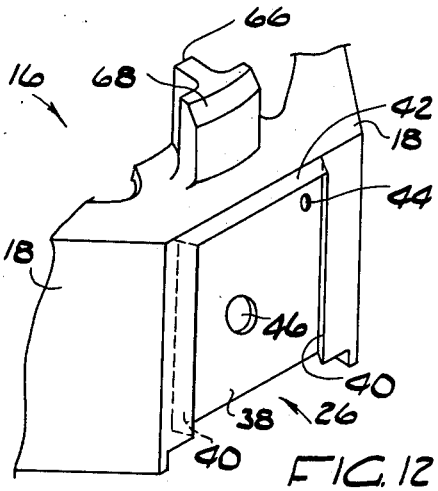

The complementary connecting formation 26 of the top clip 16 is particularly illustrated in FIG. 12 of the drawings, and is now described with particular reference to FIG. 12 of the drawings.

The complementary connecting formation 26 of the bottom clip 16 corresponds with the complementary connecting formation 26 of the top clip 16.

With reference to FIG. 12 of the drawings, the top clip 16 is shown having a complementary connecting formation 26 in its rear face.

The complementary connecting formation 26 comprises a groove formation which is defined by a base wall 38, two opposed tapered side walls 40, and an end wall 42.

The opposed tapered side walls 40 are tapered to correspond with the tapered edges 32 of the connecting formation 24, thereby allowing the connecting formation 24 to be inserted into a complementary connecting formation 26 by longitudinal displacement of the backstrap 14 relatively to the top clip 16 or the bottom clip 20.

The end wall 42 prevents the connecting formation 24 from being inserted into a complementary connecting formation 26 from the incorrect side, and limits the extent by which the connecting formation 24 can be inserted into the complementary formation 26.

The base wall 38 is provided with a complementary locking formation 44 which is complementary to the locking formation 34, and is adapted to receive the locking formation 34 to locate a connecting formation 24 in position in a complementary connecting formation 26.

The base wall 38 is further provided with a hole 46 while will be in register with the hole 28 of a connecting formation 24 located in a complementary connecting formation 26, so that a fixing screw 30 as hereinbefore described, can pass through the holes 46 and 28 as illustrated in FIG. 3 of the drawings.

With particular reference to FIG. 3 of the drawings, an aerosol fire extinguisher container 12 is indicated in dotted lines, in position in the holder 10.

The container 12 is of usual type, and is in the form of a sheet metal cylinder having a concave base 48 and a domed top 50 having a curved surface 52 between the domed top 50 and the side walls of the container 12.

The container 12 has an outlet nozzle 54 provided on an actuating button 56. In use, the actuating button 56 is adapted to be depressed to cause flow out of the nozzle 54.

The container support 8 further includes a protective cap 58 which is adapted to be removably located in an operative position on the holder 10 to protect the actuating button 56 and nozzle 54 of the container 12 when located in position in the holder 10.

The protective cap 58 has engagement formations, and the top clip 16 has complementary engagement formations which are adapted to be engaged to removably locate the protective cap 58 in its operative position on the holder 10. The engagement formations and complementary engagement formations will be described in more detail hereunder.

The container support 8 further includes bias means adapted to be triggered by withdrawal of the container 12 from the holder 10, to bias the protective cap 58 and the holder 10 away from each other until disengagement of the engagement and complementary engagement formations results in the protective cap flipping into an inoperative position.

The bias means is provided by a bias zone 60 of the protective cap 58.

In some embodiments as illustrated in the drawings, the bias zone 60 is provided by a depending lip 60.1 which depends from the cap 58. However, in FIG. 14 of the drawings, the bias zone 60 is provided by the front edge of the cap 58.

During withdrawal of the container 12 from the holder 10, the curved surface 52 of the container 12 will act against the bias zone 60 to trigger the bias means by displacing the depending lip 60.1 or front edge of the protective cap 58, as the case may be, upwardly. The bias means will therefore tend to bias the protective cap 58 and the holder 10 away from each other, thus leading to a tendency for the engagement formations of the cap 58 and the complementary engagement formations of the top clip 16 to become disengaged.

The bias means is further provided by the fact that the arms 18 of the top clip 16 embrace the container 12. Thus, during withdrawal of the container 12 from the holder 10, the arms 18 will be resiliently flexed outwardly thereby affecting the disengagement between the protective cap 58 and the arms 18.

Since the curved surface 52 of the container 12 will commence displacing the bias zone 60 upwardly, before the protective cap 58 is disengaged from the arms 18, as will be hereinafter described, when disengagement finally occurs, the protective cap 58 will be flipped upwardly and away from the container 12 and the holder 10 to a position remote from the holder 10. Thus ready access to the actuating button 56 is provided.

The top and bottom clips 16 and 20 include shoulder means 62 and 64 respectively to combat axial displacement of a container 12 held in the holder 10.

The shoulder means 62 is provided by inwardly tapering projections on the inner faces of the arms 18. The shoulder means 64 is provided by lugs which project inwardly from the arms 22 and inwardly from the junction of the arms 22.

The shoulder means 62 will thereby bear on the curved surface 52 of the container 12, whereas the bottom of the container 12 will be supported by the shoulder means 64.

The top clip 16 further includes locating means 66 for locating the protective cap 58 on the holder 10, and for combatting displacement of the protective cap 58 with the container 12, during withdrawal of the container 12 when it is held in position by the holder 10.

The locating means 66 is in the form of a projection which is of T-shape in plan view, and which has a bevelled edge 68 at its rear, to facilitate placing of the protective cap 58 in position on the holder 10.

As previously mentioned, the protective cap 58 has engagement formations, and the top clip 16 has complementary engagement formations which are adapted to be engaged to locate the protective cap 58 in its operative position on the holder 10.

Different types of engagement formations and complementary engagement formations are illustrated in different Figures of the drawings, and these engagement formations and complementary engagement formations are now described in more detail with reference to the specific drawings.

With reference to FIGS. 1 to 4 of the drawings, the embodiment of the protective cap 58 as illustrated in these drawings, has engagement formations in the form of opposed grooves 70 in the outer faces of the protective cap 58. The top clip 16 has complementary engagement formations in the form of hook formations 72 which project from the top clip 16.

Figure 2:
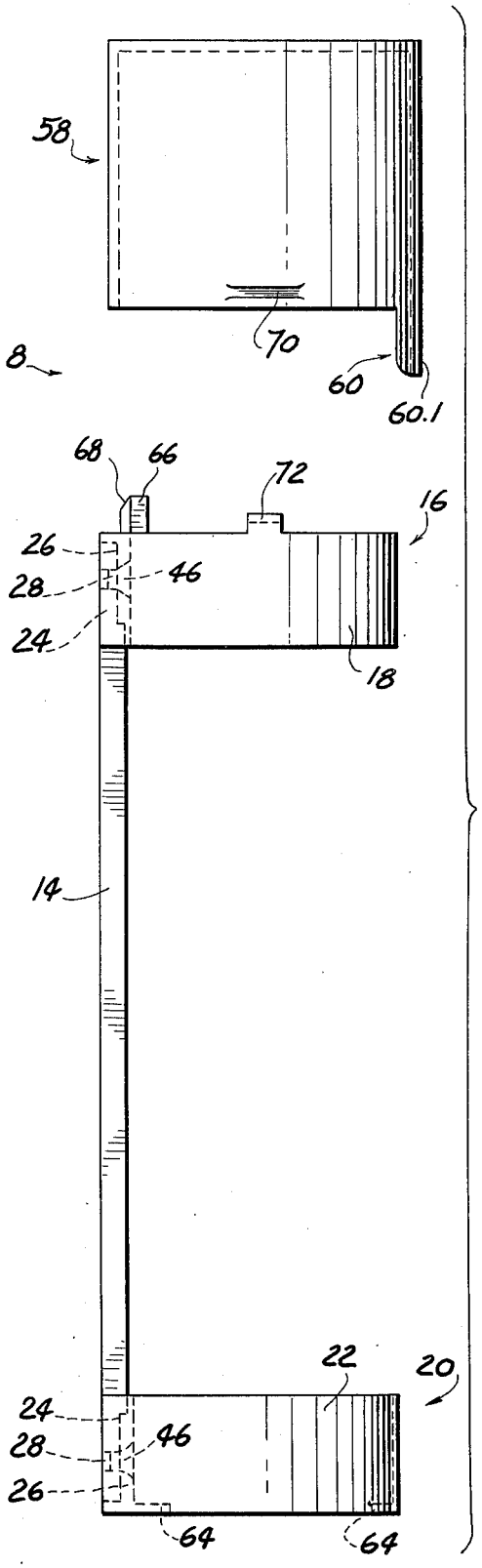
FIG. 2 shows a side elevation of the container support of FIG. 1.
Figure 4:
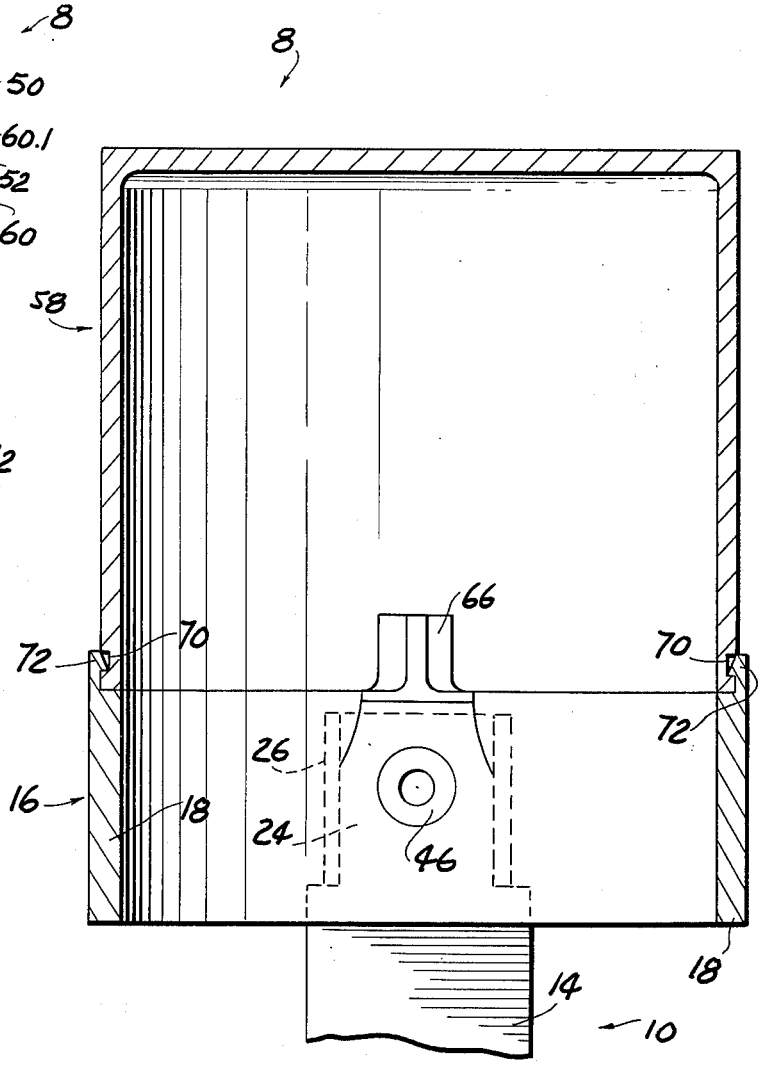
FIG. 4 shows a fragmentary sectional front elevation of the holder and cap of FIG. 3, to an enlarged scale.

The grooves 70 and hook formations 72 are shown in their unengaged position in FIGS. 1 and 2 of the drawings, whereas they are shown in their engaged position in FIGS. 3 and 4 of the drawings.

Thus, when the container 12 is withdrawn from the holder 10 by manually pulling the container 12 away from the holder 10 in a direction normal to the longitudinal axis of the container 12, the bias means will be triggered by the curved surface 52 of the container 12 acting on the depending lip 60.1 of the bias zone 60 of the cap 58, thereby biassing the front edge of the protective cap 58 upwardly. This bias action will ensure that when the container 12 has been withdrawn sufficiently from the top clip 16 to expand the arms 18 sufficiently, the hook formations 72 will become disengaged from the grooves 70 whereupon the protective cap 58 will be flipped into an inoperative position away from the container 12 and the holder 10.

The locating means 66 ensures that the bias means resulting from the bias action of the curved surface 52 on the bias zone 60 is not dissipated by displacement of the cap 58 together with the container 12 during withdrawal of the container 12 from the holder 10.

Figure 7:
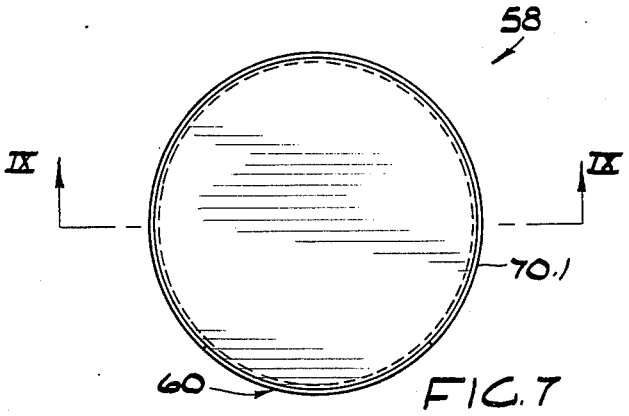
FIGS. 7, 8 and 9 show a plan view, a side elevation, and a sectional view along line IX—IX in FIG. 7 respectively of an alternative embodiment of a protective cap.
Figure 9:
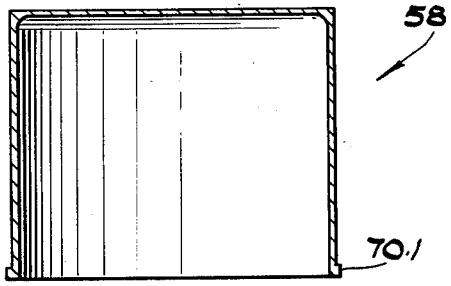
Figure 8:
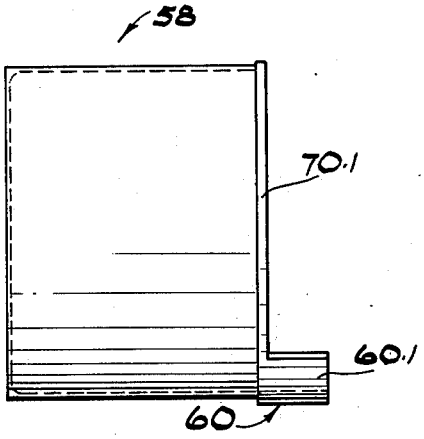
Figure 10:
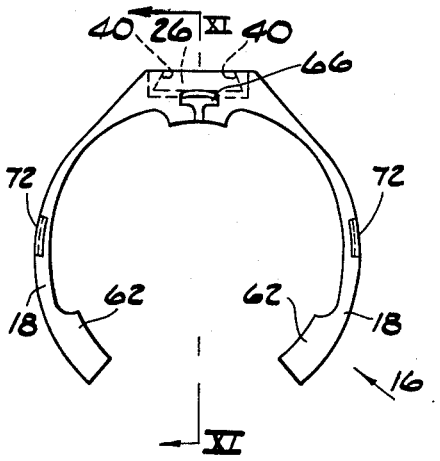
FIGS. 10, 11 and 12 show a plan view, a sectional view along line XI—XI in FIG. 10, and a fragmentary perspective rear view to an enlarged scale, of a top clip of the holder of FIGS. 1 to 4, suitable for engagement by the protective cap of FIGS. 1 to 4, or by the protective cap of FIGS. 7 to 9.
Figure 11:
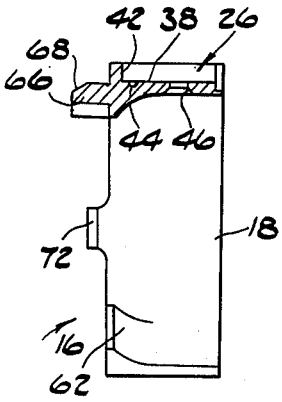

In the embodiment of the protective cap 58 as illustrated in FIGS. 7 to 9 of the drawings, the engagement formation is provided by an annular ridge 70.1 which extends around the cap 58. In this embodiment of the protective cap 58, complementary engagement formations 72 of the top clip 16 will be in the form of those as illustrated in FIGS. 1 to 4 of the drawings, or in the form of those as illustrated in FIGS. 10 to 12 of the drawings.

Figure 13:
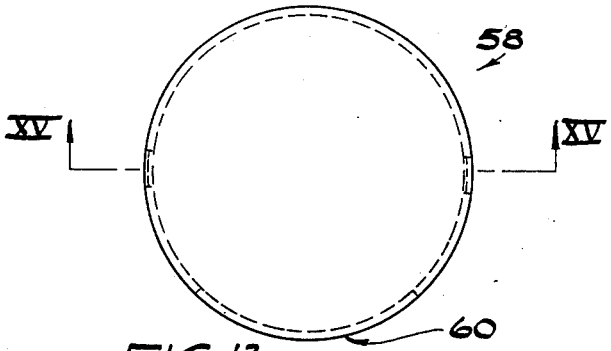
FIGS. 13, 14 and 15 show a plan view, a side elevation, and a sectional front elevation along line XV—XV in FIG. 13 respectively, of a further embodiment of a protective cap.
Figure 15:
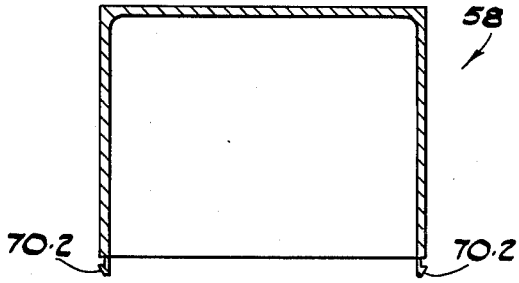
Figure 14:
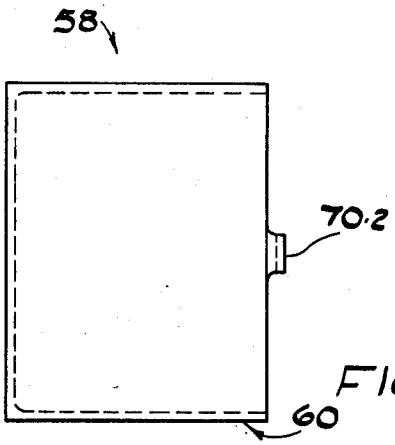

With reference to FIGS. 13 to 15 of the drawings, the embodiment of the protective cap 58 as illustrated, has engagement formations in the form of hooks 70.2 which depend from th protective cap 58.

Figure 16:
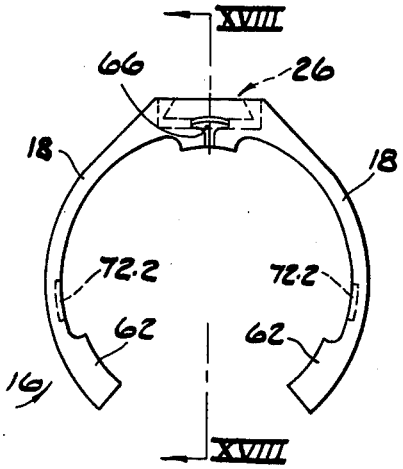
FIGS. 16, 17 and 18 show a plan view, a front elevation, and a sectional side elevation along line XVIII—XVIII of FIG. 16 respectively of a top clip for engagement by the protective cap of FIGS. 13 to 15.
Figure 18:
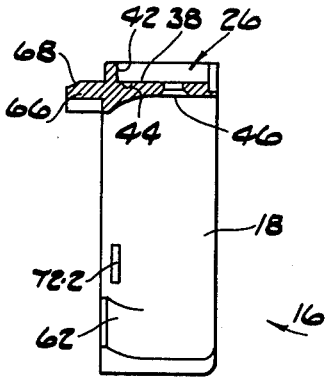
Figure 17:
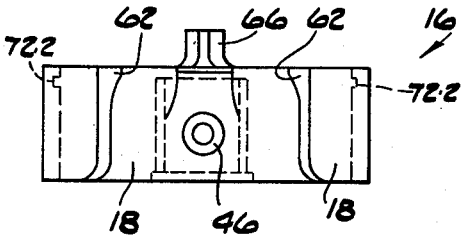

For this embodiment of the invention, a top clip 16 having complementary engagement formations to those illustrated in FIGS. 16 to 18 of the drawings, will be used.

The complementary engagement formations as illustrated in FIGS. 16 to 18 of the drawings, comprise slots 72.2 provided in the inner faces of the arms 18.

Figure 19:
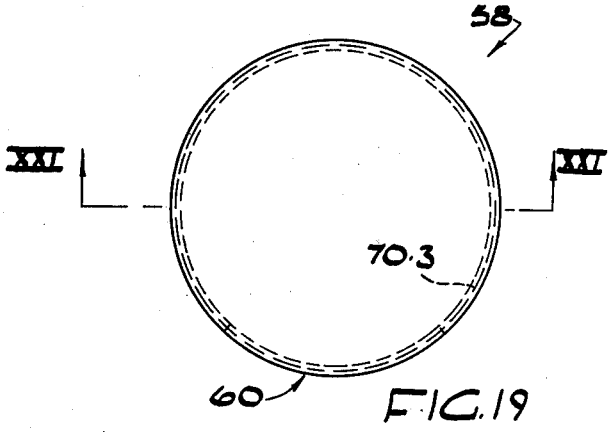
FIGS. 19, 20 and 21 show a plan view, a side elevation and a sectional front elevation along line XXI—XXI of FIG. 19 respectively, of a further embodiment of a protective cap.
Figure 20:
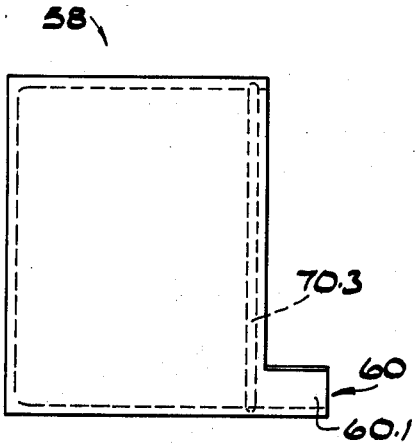
Figure 21:
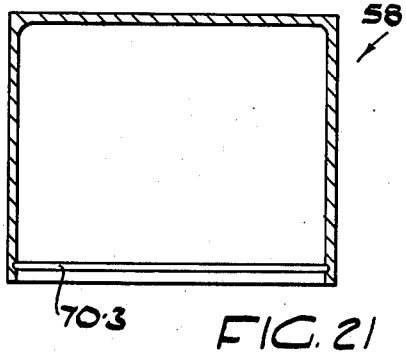

In the embodiment of the protective cap 58 as illustrated in FIGS. 19 to 21 of the drawings, the cap 58 is provided with an engagement formation in the form of an annular groove 70.3 along an inner face of the cap 58.

Figure 22:
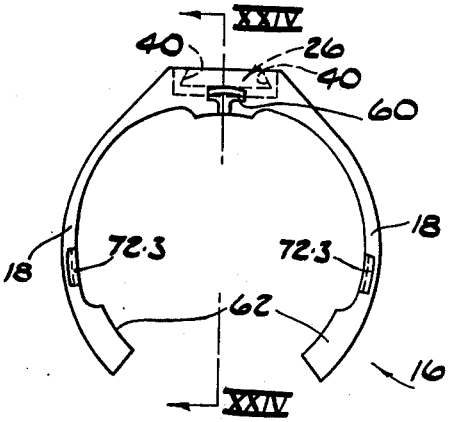
FIGS. 22, 23 and 24 show a plan view, a front elevation and a sectional side elevation along line XXIV—XXIV of FIG. 22 respectively, of a top clip for engagement by the protective cap of FIGS. 19 to 21.
Figure 24:
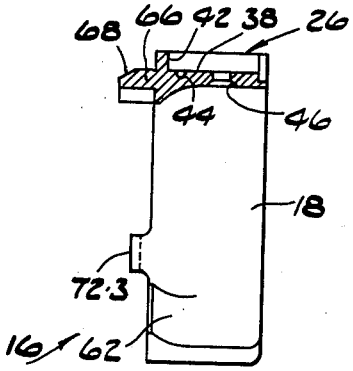
Figure 23:
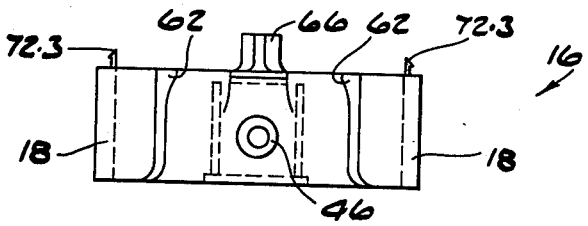

For this embodiment of the invention, a top clip 16 having complementary engagement formations to those illustrated in FIGS. 22 to 24 of the drawings, will be used.

The complementary engagement formations are provided by hooks 72.3 which project upwardly from the top clip 16 and are directed outwardly.

It will be appreciated that numerous other types of engagement formations and complementary engagement formations can readily be provided which will serve the same purpose as the engagement formations and complementary engagement formations as illustrated in the drawings.

It will be appreciated that the container support 8 can readily be secured to a desired support surface by passing fixing screws 30 (as illustrated in FIG. 3 of the drawings) through aligned holes provided in the top and bottom clips 16 and 20, and in the backstrap portion 14. The fixing screws 30 will thus serve to connect the top and bottom clips 16 and 20 securely to the backstrap portion 14.

The container support 8 may therefore be fixed to a wall, a pillar, a convenient surface in a vehicle, or the like.

An aerosol container 12 can then be located in position in the holder 10 by inserting it into the top and bottom clips 16 and 20. Thereafter, the protective cap 58 can be readily located in position on the holder 10.

When the container 12 is required for emergency use, it can be gripped in one hand and can be withdrawn from the holder by pulling the container 12 in a direction away from the holder 10 and transversely to the longitudinal axis of the container 12. During such withdrawal, the engagement and complementary engagement formations will suddenly become disengaged resulting in the protective cap 58 being flipped away from the holder 10 and the container 12, thereby exposing the actuating button 56 and the nozzle 54 for use.

It is an advantage of the embodiments of the invention as illustrated in the drawings, that the container 12 can be provided fro emergency use by merely grasping the container 12 and jerking it out of the holder 10. The protective cap 58 is automatically removed so that the container 12 is ready for use as soon as it has been withdrawn from the container support 8.

I claim:

1. A container support for supporting a tubular container having an outlet at its one end, and comprising a holder having a pair of resiliently expandable arms to embrace such a container, a protective cap adapted to be removably located on the arms to protect the outlet of such a container held by the arms, the protective cap having an end wall and a skirt portion extending from the end wall, complementary engagement formations on the skirt portion and the arms which are adapted to be engaged to locate the cap on the arms to combat relative displacement in the direction of the polar axis of the skirt portion, locating means to locate the cap on the arms to combat relative displacement in a direction transversely to the polar axis of the skirt portion, and a bias zone on the cap to be engaged by a supported container to bias the cap away from the arms against the action of the engaged complementary engagement formations during withdrawal of such a container from the arms in a direction transversely to the polar axis of the container, the complementary engagement formations being adapted to become disengaged when the arms have been expanded by such a container during withdrawal thereof, to allow the biassing action so generated to cause the cap to flip off upon disengagement of the engagement formations.

2. A container support according to claim 1, in which the locating means projects from the holder and is adapted to abut an inner surface of the skirt portion when the cap is located on the arms.

3. A container support according to claim 1, in which the complementary engagement formations comprise a groove formation in the outer surface of the skirt portion on opposed sides of the protective cap, and an inwardly directed hook formation on each arm.

4. A container support according to claim 1, in which the holder includes shoulder means to combat axial displacement relatively to the arms, of such a container held by the arms.

5. A container support according to claim 1, including a second pair of resiliently expandable arms for embracing such a container, the second pair of arms being spaced from the first pair of arms.

6. A container support according to claim 5, in which the two pairs of arms include shoulder means to combat axial displacement relatively to the arms, of such a container held by the arms.

7. A container support according to claim 5, in which the holder includes a bakcstrap portion adapted to be mounted on a surface, the backstrap portion having spaced connecting formations, and the two pairs of arms having complementary connecting formations removably engaged with the connecting formations to connect the pairs of arms and the backstrap portion.

8. The combination of a container support as claimed in claim 1, and a tubular container having an outlet at its one outlet end, the container being adapted to be removably supported by the holder with its outlet protected by the protective cap located on the arms of the holder.

9. The combination according to claim 8, in which the container is a container of the aerosol type having an actuating knob extending from its outlet end, and having an outlet nozzle leading from its outlet, and in which the protective cap is adapted to protect both the actuating knob and the outlet nozzle when located on the arms.

10. A holder for removably holding a container of the aerosol type, which is tubular, has a domed end with an actuating knob and an outlet and has a protective cap with an end wall and an annular skirt extending from the end wall, with the annular skirt having engagement formations on opposed sides thereof, the holder having a pair of resiliently expandable arms for embracing the container, the arms having complementary engagement formations which are adapted to be engaged with the engagement formations of the skirt to locate the protective cap on the arms and combat displacement of the cap relatively to the arms in the direction of the polar axis of the skirt, and the holder further having locating means to engage with the cap and locate it against displacement with the container during withdrawal of the container out of the holder in a direction transversely to the polar axis of the container, the complementary engagement formations being adapted to become disengaged from th engagement formations of the skirt when the arms have been expanded during withdrawal of the container, leading to a biassing action generated by the domed end of the container biassing the skirt away from the arms during withdrawal of the container, being released to cause the cap to flip off.

* * * * *